US009180342B2

(12) United States Patent
Chiang

(10) Patent No.: US 9,180,342 B2
(45) Date of Patent: Nov. 10, 2015

(54) SWIMMING GOGGLES

(71) Applicant: GLOBAL ESPRIT INC., New Taipei (TW)

(72) Inventor: Herman Chiang, New Taipei (TW)

(73) Assignee: GLOBAL ESPRIT INC., New Taipei (TW)

( * ) Notice: Subject to any disclaimer, the term of this patent is extended or adjusted under 35 U.S.C. 154(b) by 32 days.

(21) Appl. No.: 13/940,254

(22) Filed: Jul. 11, 2013

(65) Prior Publication Data

US 2014/0359923 A1 Dec. 11, 2014

(30) Foreign Application Priority Data

Jun. 6, 2013 (TW) ..... 102210643 U

(51) Int. Cl.
*A63B 33/00* (2006.01)

(52) U.S. Cl.
CPC ..... *A63B 33/002* (2013.01); *A63B 2033/004* (2013.01)

(58) Field of Classification Search
CPC ..... A63B 33/002; A63B 33/00; A63B 2033/004; A63B 2033/006; A61F 9/026; A61F 9/02; B63C 11/12
USPC ..... 2/442, 426, 428, 440, 445–448, 452
See application file for complete search history.

(56) References Cited

U.S. PATENT DOCUMENTS

| | | | | |
|---|---|---|---|---|
| 5,331,691 | A * | 7/1994 | Runckel | 2/428 |
| 6,289,523 | B1 * | 9/2001 | Chiang | 2/428 |
| 6,321,390 | B1 * | 11/2001 | Chiang | 2/428 |
| 2009/0064399 | A1 * | 3/2009 | Chou | 2/442 |
| 2010/0083426 | A1 * | 4/2010 | Chiang | 2/428 |
| 2011/0088150 | A1 * | 4/2011 | Tominaga et al. | 2/440 |

* cited by examiner

*Primary Examiner* — Andrew W Collins
(74) *Attorney, Agent, or Firm* — Cheng-Ju Chiang

(57) ABSTRACT

Swimming goggles include left and right frame bodies installed with lenses, a connecting element, and protective pads and head strap bases. The left and right frame bodies each has inner and outer peripheral faces. The protective pads each has a connecting portion having a connecting face and an abutting face. Lip portions are respectively formed along the inner peripheral faces of the left and right frame bodies. The connecting faces integrally encompass the lip portions. The abutting faces are inclined with respect to face portions corresponding to an area above the eye socket and adjacent to an eyebrow, a side portion of a nose bridge adjacent to lacrimal gland at an inner side portion of the eye socket, an area adjacent to an under-eye bag below the eye socket, and an outer eye corner with respect to an outer side portion of the eye socket adjacent to a temple.

6 Claims, 12 Drawing Sheets

SWIMMING GOGGLES

BACKGROUND OF THE INVENTION

1. Field of the Invention

The present invention relates to swimming goggles, and particularly to swimming goggles capable of being fit for face portions with respect to peripheral portions of eyes, a nose bridge, and a wearer's head, and being worn comfortably without feeling pressure and causing water leakage, and can provide a better range of visual field in swimming.

2. Related Art

Swimming goggles are mainly designed to protect eyes and to be prevented from being leaked into water when swimming. As is well known, swimming goggles are worn on face portions corresponding to outer peripheral portions of eye sockets of a cranium. As bold lines shown in FIG. 10, each face portion is defined to correspond to an area 60 above an eye socket and adjacent to an eyebrow 70, a side portion of a nose bridge adjacent to lacrimal gland 71 at an inner side portion 61 of the eye socket, an area 62 adjacent to an under-eye bag 72 below the eye socket, and an outer eye corner 73 with respect to an outer side portion 63 of the eye socket adjacent to a temple. The function of water leakage-proof for swimming goggles is known to be achieved by providing sponge-type protective pads at early times and currently suction-type protective pads. Those protective pads are being attached to the face portions to prevent water leakage through flexibility of a sponge material or a suction force of a suction-type pad. Contours of the face portions with respect to the outer peripheral portions of the eye sockets are not flat; however, a sponge-type protective pad of conventional swimming goggles has a same thickness in vertical cross section. As a result, conventional swimming goggles cannot be perfectly attached to the face portions unless the sponge-type protective pad is being compressed to fit the face portions by a greater force to tighten a head strap when wearing the conventional goggles. Likewise, as to the suction-type swimming goggles, a profile of a suction pad as viewed from a top or bottom angle is parallel with a lens and is without being curved to a front side of the lens, whereby a wearer also needs to use a greater force to tighten the head strap in order to make the suction-type protective pad tightly attached to the face portion, otherwise water leakage may occur. It can be expected from the above disclosure, either sponge-type or suction-type protective pads are likely to cause red circle eyes or even swollen eyes after taking off swimming goggles due to excessive attachment to the face portions with respect to the outer peripheral portions of the eye sockets and definitely make wearers uncomfortable in wearing.

Furthermore, tightening the head strap is necessary to enable protective pads to be attached to the outer peripheral portions of the eye sockets so as to avoid water leakage. Due to the relation between ears and eyes in position, the head strap cannot be adjusted horizontally but obliquely in a direction above ears. Consequently, connecting elements of swimming goggles for connecting the head strap, and the protective pads are being tilted upward in conjunction with the adjustment of the head strap and that results in an incomplete contact between the protective pads and the face portions where side portions of a nose bridge (inner peripheries of eye sockets) adjacent to lacrimal gland and corners of eyes (outer peripheries of eye sockets) may occur water leakage, especially for users having high nose bridges. In short, because the connecting elements are directly fixedly mounted to left and right frames of conventional swimming goggles, attachment of the protective pads to the face portions are affected when adjusting the head strap no matter the connecting elements are made of a hard or soft material.

Still further, conventional swimming goggles are needed to be taken off from a wearer to adjust a head strap, and therefore is very inconvenient. Although there is another type of swimming goggles that allows a head strap to be adjusted without being taken off, the adjustment of the head strap also affects the attachment of the protective pads to the face portions and may cause red circle eyes as well. What is more is conventional swimming goggles are equipped with buckles that are fixedly mounted to side portions of left and right frames and have engaging bars each is formed on a control plate (control button) to engage or disengage the head strap by pulling away the control plate (or pressing the control button). However, the buckles are being moved in conjunction with the action of pulling away the control plate (or pressing the control button) and thus directly affect positions of the protective pads of the left and right frames on the face portions. In this case, it may make eyes feel uncomfortable or even cause red circle eyes as the attachment of the protective pads is transiently away from the face portions.

Additionally, regarding conventional swimming goggles having lenses and left and right frames integrally formed together, the lenses are in a flat plan configuration having mold cores and mold lines with respect to the left and right frames. Portions of the lenses between the mold lines and the left and right frames tend to block visual fields of a wearer and increase water resistance in swimming. On the other hand, thicknesses of the left and right frames in vertical cross section are same at upper and lower edges thereof. As a result, the upper edges of the left and right frames are positioned further to the face portions than lower edges thereof (as shown in FIG. 10, the face portions with respect to the outer peripheral portions of the eye sockets) and thus block visual fields of corners of eyes in swimming.

SUMMARY OF THE INVENTION

Accordingly, an object of the present invention is to provide swimming goggles that are fit for face portions with respect to outer peripheral portions of eye sockets of a cranium so as to be worn comfortably smoothly without water leakage.

Another object of the present invention is to provide swimming goggles that are fit for various shapes of nose bridges and perfectly attached to face portions without being affected in attachment to face portions when being worn, so as to ensure that no water leakage occurs in swimming.

Another object of the present invention is to provide swimming goggles that are not affected in attachment to face portions when adjusting a head strap, and are capable of not causing red circle eyes or making eyes uncomfortable.

Still, another object of the present invention is to provide swimming goggles capable of reducing water resistance in swimming, preventing visual fields of eye corners from being blocked by goggle frames so as to provide a better and wider range of visual field in swimming.

To achieve the above-mentioned objects, the swimming goggles comprises a left frame body and a right frame body, each of the left and right frame bodies having an inner peripheral face and an outer peripheral face; lenses respectively integrally formed with the outer peripheral faces of the left and right frame bodies; a connecting element interconnecting the left and right frame bodies; and protective pads respectively attached to the inner peripheral faces of the left and right frame bodies. Each of the protective pads has a connecting portion comprising a connecting face and an abutting face. Head strap apparatus are respectively disposed on outer sides of the left and right frame bodies. Lip portions are respectively formed along the inner peripheral faces of the left and right frame bodies. The connecting faces of the connecting portions integrally encompass the lip portions, and each of the abutting faces of the connecting portions is inclined with respect to a face portion corresponding to an outer peripheral portion of an eye socket of a cranium. The face portion is defined to include an area above the eye socket and adjacent to an eyebrow, a side portion of a nose bridge adjacent to lacrimal gland at an inner side portion of the eye socket, an area adjacent to an under-eye bag below the eye socket, and an outer eye corner with respect to an outer side portion of the eye socket adjacent to a temple, whereby the swimming goggles being perfectly fit for the face portions with respect to the outer peripheral portions of the eye sockets so as to be worn comfortably without being leaked into water and a feeling of compression.

According to one aspect of the present invention, each of the protective pads further comprises a face contact portion coupled with the abutting face of the connecting portion, and having curved contours with respect to the face portion corresponding to the outer peripheral portion of the eye socket of the cranium. An upper half part of the face contact portion with respect to the eyebrow and a lower half part of the face contact portion with respect to the under-eye bag are curved at different angles as viewed from top and bottom plans.

According to another aspect of the present invention, each of the left and right frame bodies has an upper thickness with respect to the eyebrow and a lower thickness with respect to the under-eye bag in vertical cross section, and the upper thickness is less than the lower thickness so as to allow each of the left and right frame bodies to be fit for contours of the eyebrow and the under-eye bag, and prevent visual fields of eye corners from being blocked by frame bodies and thus provide a better visual field in swimming.

According to another aspect of the present invention, the connecting element has opposite two ends respectively forming connecting pegs, each of the connecting pegs comprising a neck portion and an engaging portion, one side of each of the left and right frame bodies integrally extends outward to form a connecting base, and the connecting base is defined with a connecting hole where the neck portion is pivotally installed therein with the engaging portion mounted over the connecting base so that the left and right frame bodies are rotatable with respect to the connecting pegs.

According to another aspect of the present invention, each of the head strap apparatus comprises a base, a strap buckle and a shaft rod. The bases integrally respectively extend from sides of the left and right frame bodies and respectively form axial holes thereon. The strap buckle comprises a coupling opening, a first connecting hole, a second connecting hole, and a strap through hole. The coupling opening is intended to accommodate the base and is defined with a limiting wall, a guiding peg is mounted to the second connecting hole to define the strap through hole, and the shaft rod passes through the first connecting hole to be installed in the axial hole so as to pivotally connect the strap buckle with the base, whereby the strap buckle being rotatable with respect to the shaft rod against the limiting wall.

DESCRIPTION OF THE PREFERRED EMBODIMENTS

Figure 1:
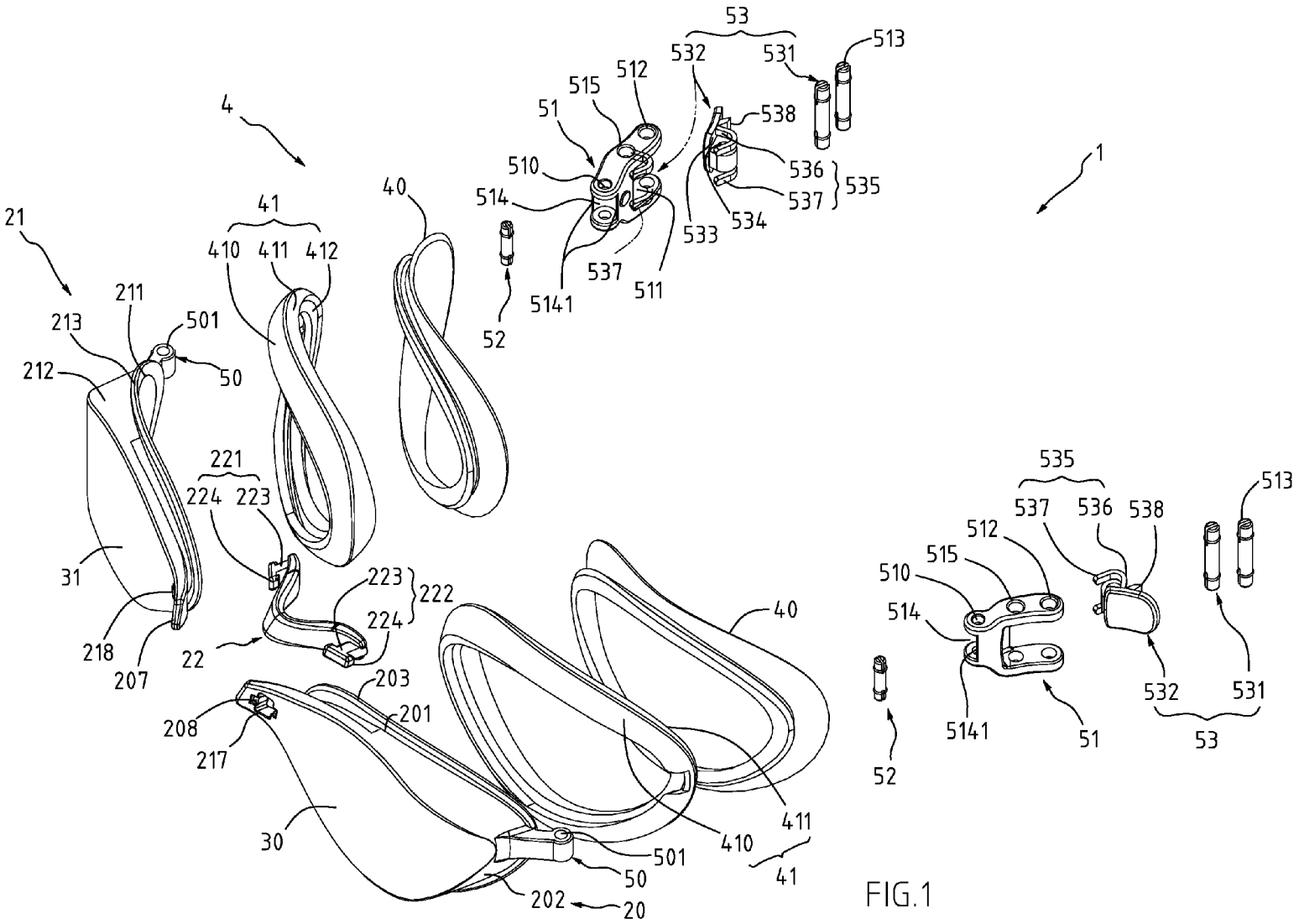
FIGS. 1 and 2 are respectively a front, right perspective exploded view and a rear, right perspective exploded view of a first embodiment of swimming goggles of the present invention.

Referring to FIGS. 1 to 6, swimming goggles 1 of the present invention comprise a left frame body 20, a right frame body 21, a connecting element 22, lenses 30 and 31 received in the left and right frame bodies 20 an 21, protective pads 4, and head strap apparatus 5. The left and right frame bodies 20 and 21 are made of polycarbonate resin and respectively have inner peripheral faces 201 and 211 and outer peripheral faces 202 and 212, wherein the inner peripheral faces 201 and 211 are integrally formed with lip portions 203 and 213 (as shown in FIGS. 1 and 5B) for facilitating a grab for a plastic material when performing plastic injection molding. The lip portions 203 and 213 respectively are disposed along the inner peripheral faces 201 and 211. In vertical cross section each of the left and right frame bodies 20 and 21 has a thickness m with respect to the eyebrow and a thickness n with respect to a lower side of the under-eye bag, wherein the thickness m is different than the thickness n (as shown in FIG. 5B). In this embodiment, regarding the right frame body 21, the thickness m at an upper edge thereof is measured from the lip portion 213 to an outer surface of the lens 31 and is less than the thickness n at a lower edge of the right frame body 21 measured from the lip portion 213 to the outer surface of the lens 31. Likewise, the thicknesses m and n of the left frame body 20 are measured in the same manner as described above. In this manner, the swimming goggles 1 are capable of perfectly fitting to contours of the eyebrows and lower sides of the under-eye bags.

The lenses 30 and 31 are made of polycarbonate resin and are respectively formed with the outer peripheral faces 202 and 212 of the left and right frame bodies 20 and 21. Referring to FIGS. 4A to 4D, each of the lenses 30 and 31 has a flat portion 301 and 311 and a continuous curved portion 302 and 312. The flat portion 301 and 311 is positioned in front of an eye from a nose bridge to an outer eye corner after being worn. The continuous curved portion 302 and 312 extends and smoothly curves from the flat portion 301 and 311 with numerous arc faces smoothly curving from each other and reflecting an area from the outer eye corner to a zygomatic bone in such a manner that the continuous curved portion 302 and 312 is being chamfered at a junction of a front side and lateral side of the lens 30 and 31. More specific, each of the numerous arc faces of the continuous curved portion 302 and 312 is curved at different angles with slope continuity so as to fit for various face widths. That is, the lenses 30 and 31 together with the left and right frame bodies 20 and 21 are fit for contours of the nose bridge to the outer eye corners and the zygomatic bones with the configuration of the different thicknesses m, n. As a result, a water resistance to the swimming goggles is greatly reduced when swimming because of the streamlined shape of the lenses 30 and 31, and visual fields of eye corners are not blocked by the left and right frame bodies 20 and 21 so as to provide a better and broad visual field in swimming.

Figure 5A:
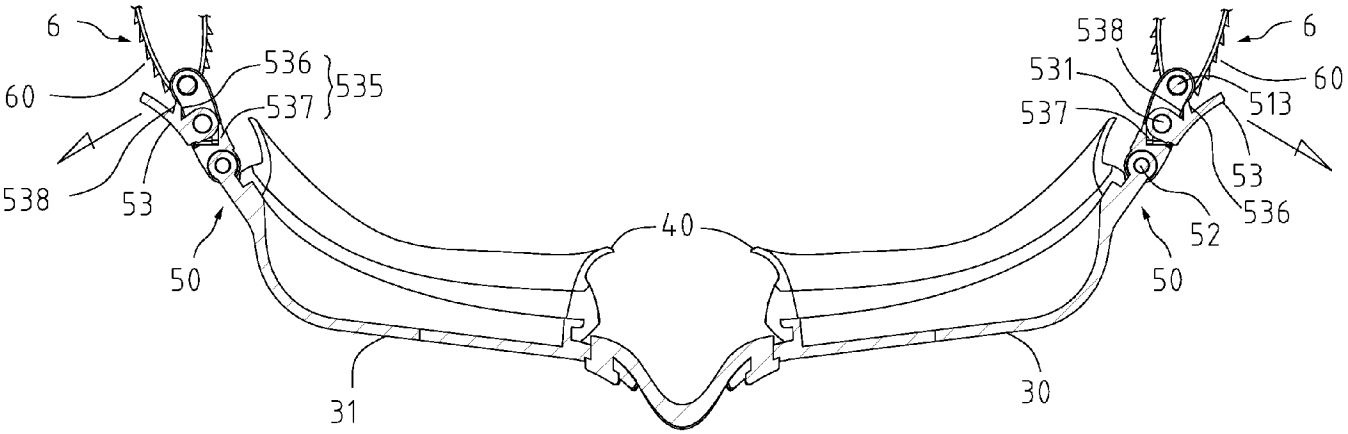
FIGS. 5A and 5B are cross-sectional views respectively taken along lines 5A-5A and 5B-5B of FIG. 4A.
Figure 5B:
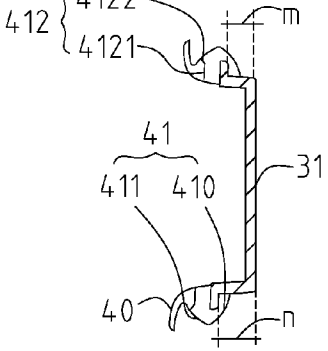
Figure 6:
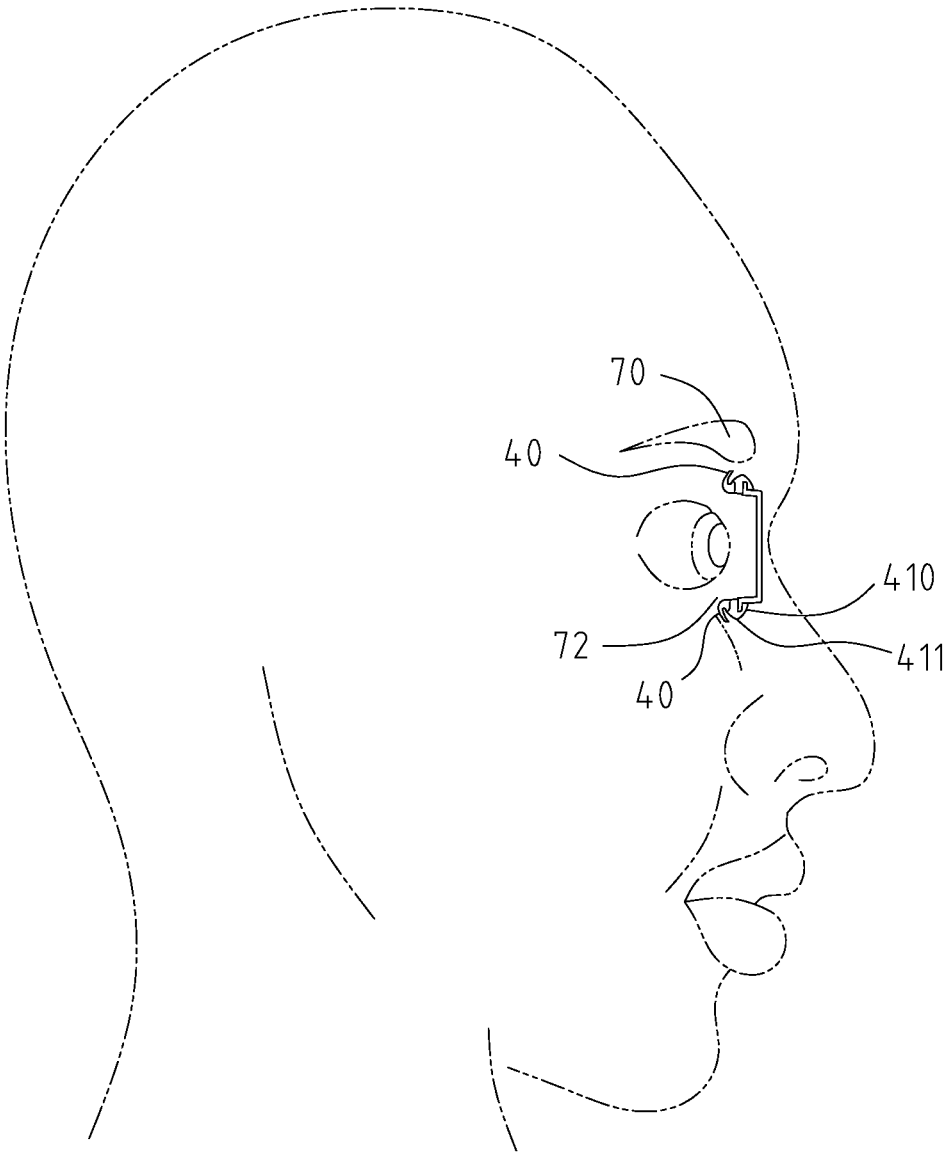
FIG. 6 is a schematic side view illustrating the swimming goggles being worn on a wearer in accordance with the first embodiment of the present invention.
Figure 7A:
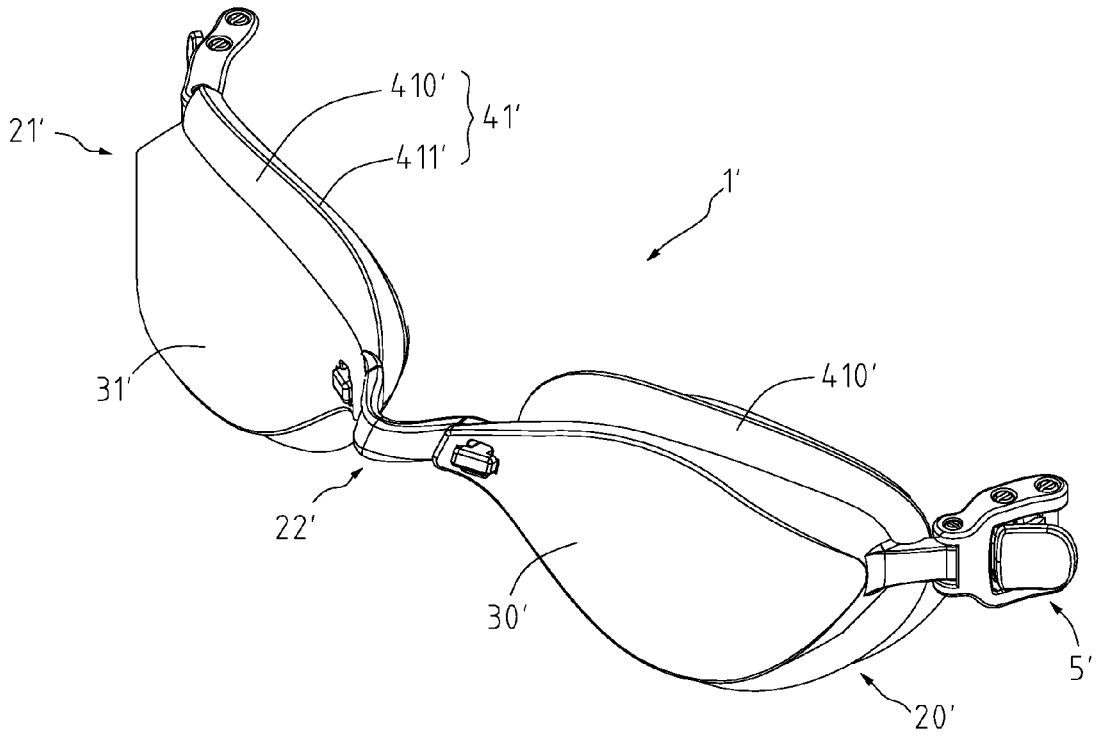
FIGS. 7A, 7B and 7C are respectively a front, right perspective view, a front elevational view, and a top plan view of a second embodiment of the swimming goggles of the present invention.
Figure 7B:
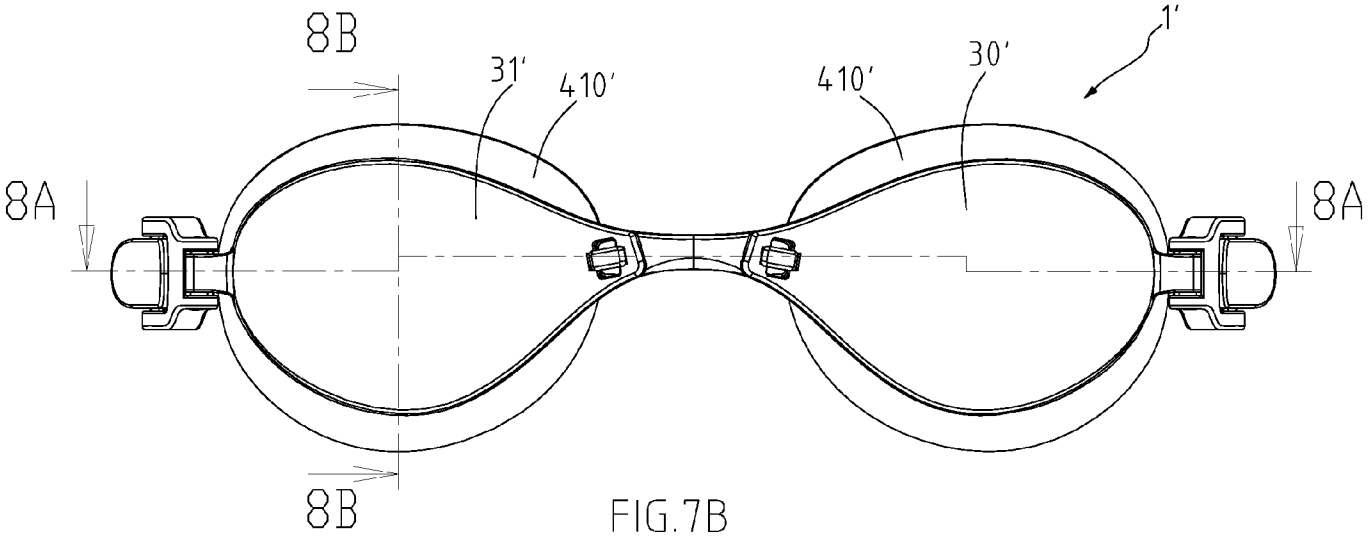
Figure 7C:
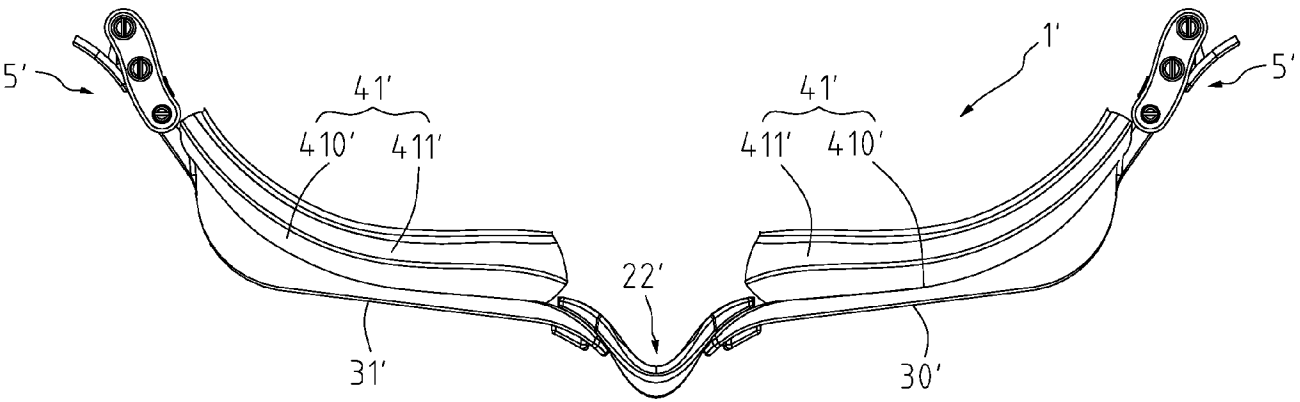
Figure 8A:
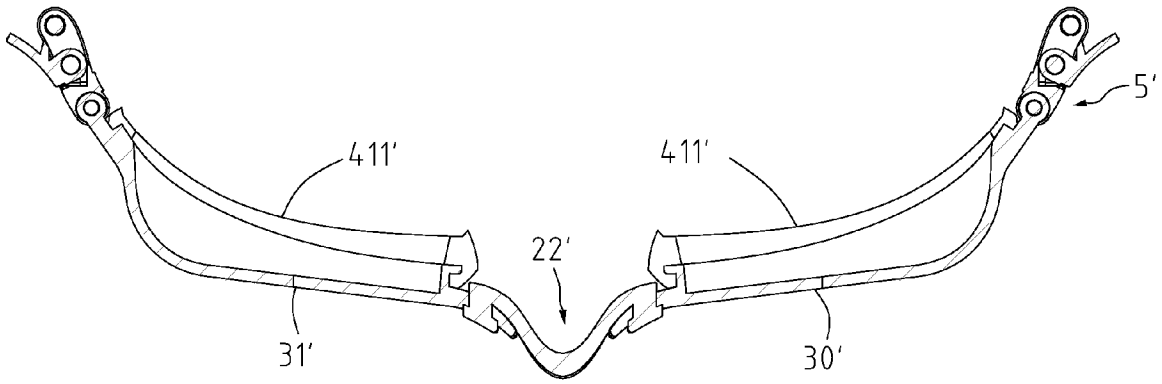
FIGS. 8A and 8B are cross-sectional views respectively taken along lines 8A-8A and 8B-8B of FIG. 7A.
Figure 8B:
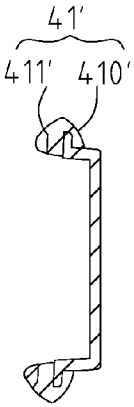
Figure 10:
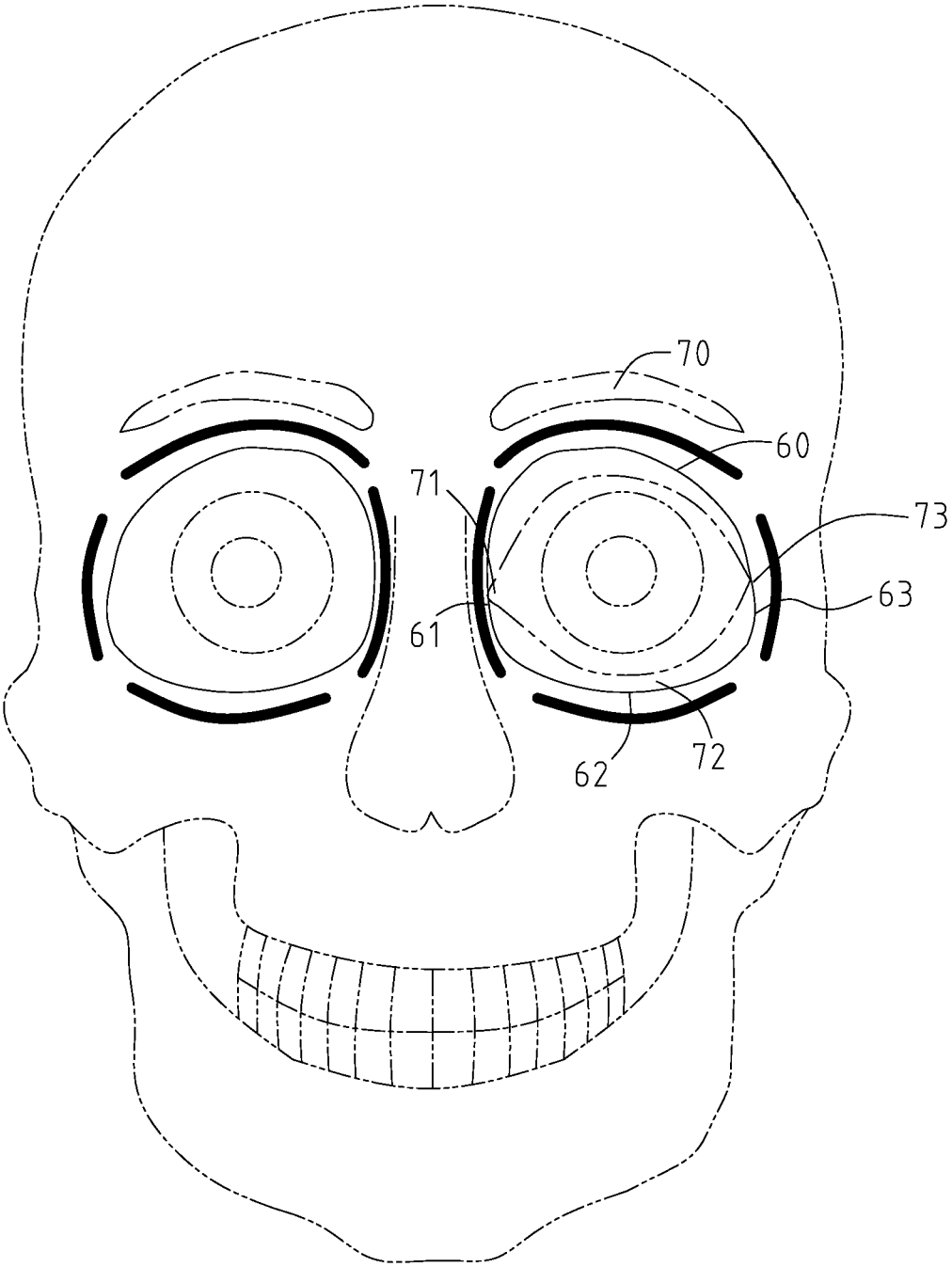
FIG.10 (Prior Art)
FIG. 10 is a schematic front elevational view showing a human's cranium and shapes of eye sockets.

The protective pads 4 are respectively attached to the inner peripheral faces 201 and 211 of the left and right frame bodies 20 and 21. Each of the protective pads 4 has a face contact portion 40 and a connecting portion 41 both made of thermal plastic rubber (TPR) by means of double shot injection molding. Alternatively, the face contact portion 40 and the connecting portion 41 are capable of being made of different materials or different colors in order to manifest colors of the protective pads 4. Additionally, the connecting portion 41 is harder than the face contact portion 40. The face contact portion 40 is made of a softer material than that of the connecting portion 41 for providing a comfortable contact with a wearer's face. Each of the connecting portions 41 comprises a connecting face 410 and an abutting face 411. Referring to FIG. 5B, the abutting face 411 has a recessed surface 412 comprising a long side 4121 portion and a short side 4122 extending and bending from the long side 4121 in cross section, the long and short sides 4121 and 4122 together provide a large area for being integrally molded with the face contact portion 40, and the short side 4122 functions as a boundary side against a plastic material when performing injection molding so as to prevent burrs from being produced on the juncture of the abutting face 411 and the face contact portion 40. The connecting portions 41 grab the lip portions 203 and 213 of the inner peripheral faces 20 and 21 over the connecting faces 410 (as shown in FIG. 5B) to integrally form the protective pads 4 with the left and right frame bodies 20 and 21. Referring to FIG. 6 in combination with FIG. 10, each of the abutting faces 411 is inclined with respect to a face portion corresponding to an outer peripheral portion of the eye socket. More specific, the face portion is defined to include an area above the eye socket and adjacent to an eyebrow, a side portion of the nose bridge adjacent to lacrimal gland at an inner side portion of the eye socket, an area adjacent to the under-eye bag below the eye socket, and the outer eye corner with respect to an outer side portion of the eye socket adjacent to a temple, whereby the swimming goggles being perfectly fit for the face portions with respect to the outer peripheral portions of the eye sockets. The face contact portion 40 is coupled with an end portion of the abutting face 411 and has curved contours with respect to the face portion corresponding to the outer peripheral portion of the eye socket of the cranium, wherein an upper half part of the face contact portion 40 with respect to the eyebrow and a lower half part of the face contact portion 40 with respect to the under-eye bag are curved at different angles as viewed from top and bottom plans. Because the face contact portion 40 and the abutting face 411 have corresponding profiles, when comparing with conventional swimming goggles in wearing, the face contact portion 40 is capable of being tightened with a less force to abut against the abutting face 411 so as to enable the swimming goggles 1 to be perfectly attached to the face portion.

In particular, as the face contact portion 40 and the abutting face 411 are inclined to the face portion corresponding to the outer peripheral portion of the eye socket, the face contact portion 40 is capable of being smoothly and perfectly attached to the face portion without being tightened in a great force. Moreover, unlike protective pads of convention swimming goggles that remain a large buffering area with the face portion and have to be worn with a greater tightening force, the face contact portion 40 of the present invention is attached to the face portion with a moderate force to provide a comfortable contact in wearing.

The connecting element 22 is pivotally connected to the left and right frame bodies 20 and 21, and has connecting pegs 221 and 222 respectively formed on opposite ends of the connecting element 22. Each of the connecting pegs 221 and 222 comprises a neck portion 223 and an engaging portion 224. The engaging portion 224 has a non-round geometric shape; and in this embodiment the engaging portion 224 is formed in a rectangular shape. One side of each of the left and right frame bodies 20 and 21 integrally extends outward to form a connecting base 207 and 217 each defined with a connecting hole 208 (218) where the neck portion 223 is pivotally installed therein with the engaging portion 224 mounted over the connecting base 207 (217). The connecting holes 208 and 218 respectively are formed in a rectangular shape corresponding to the engaging portion 224. Thus the connecting element 22 interconnects the left and right frame bodies 20 and 21 through the connecting pegs 221 and 222, and enables the left and right frame bodies 20 and 21 to be rotatable around the connecting pegs 221 and 222, respectively. Accordingly, the left and right frame bodies 20 and 21 are capable of being easily and quickly rotated to adjust positions by obliquely drawing a head strap in a direction above ears so as to fit for the side portions of the nose bridge adjacent to lacrimal gland (inner side portions of the eye sockets) and the outer eye corners (outer side portions of the eye sockets), regardless of various shapes of nose bridges. (Alternatively, the engaging portions 224 and the connecting holes 208 and 218 are in a triangle shape based on practical applications).

Each of the head strap apparatus 5 comprises a base 50, a strap buckle 51, a shaft rod 52, a restraining device 53 and a head strap 6 having multiple engaging slots 60. The bases 50 integrally respectively extend from sides of the left and right frame bodies 20 and 21 and respectively form axial holes 501 thereon. The strap buckle 51 comprises an coupling opening 514, a first connecting hole 510, a second connecting hole 512, a third connecting hole 515, and a strap through hole 511. The coupling opening 514 is intended to accommodate the base 50 and is defined with a limiting wall 5141 for limiting the course of rotation of the strap buckle 51. A guiding peg 513 is mounted to the second connecting hole 512 to define the strap through hole 511. In assembly, the shaft rod 52 passes through the first connecting hole 510 to be installed in the axial hole 501 so as to pivotally connect the strap buckle 51 with the base 50 on a side portion of the left/right frame body 20/21*f*. In this manner, the strap buckle 51 is rotatable with respect to the shaft rod 52 against the limiting wall 5141 so as to be fit for various sizes of heads.

Figure 2:
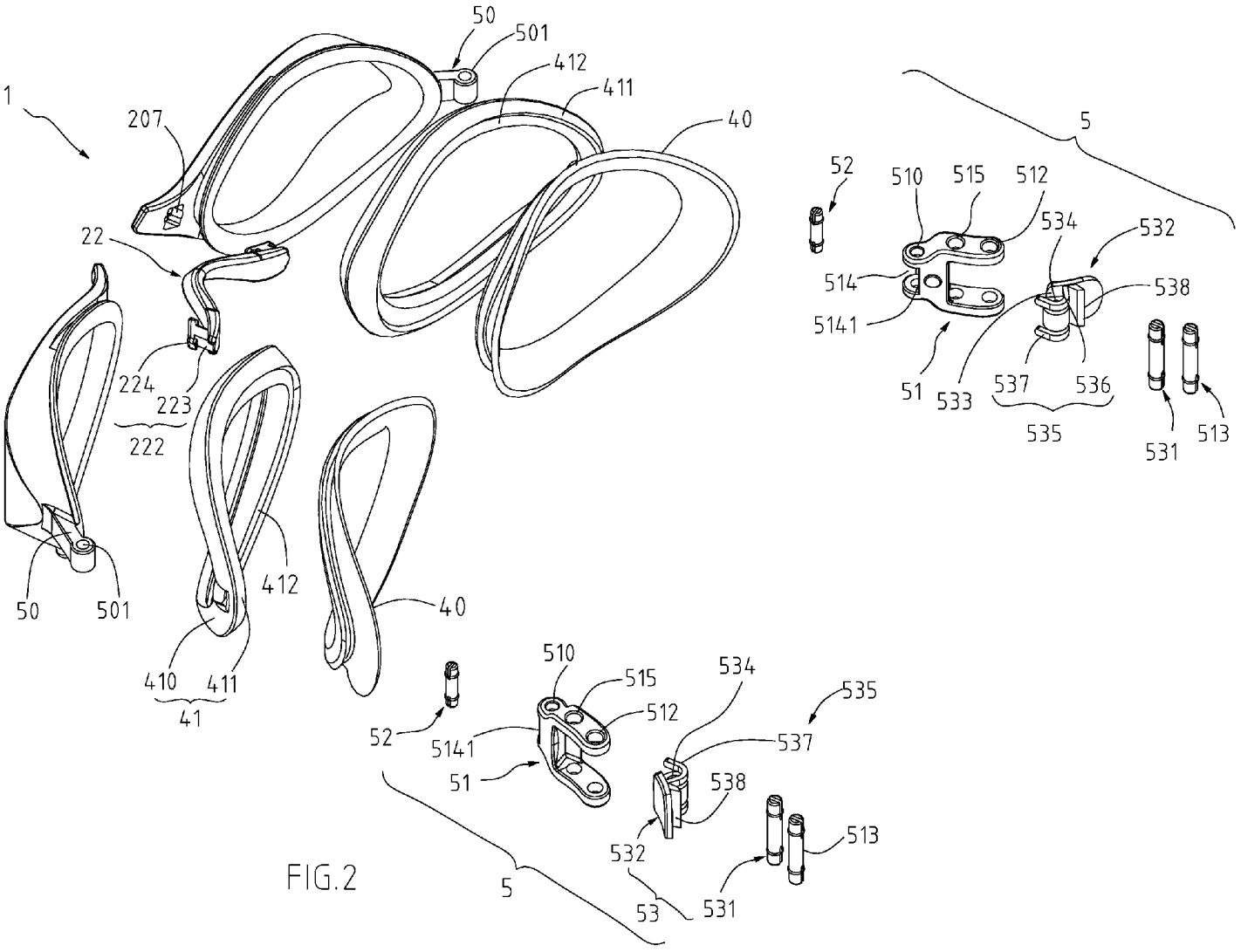
Figure 3:
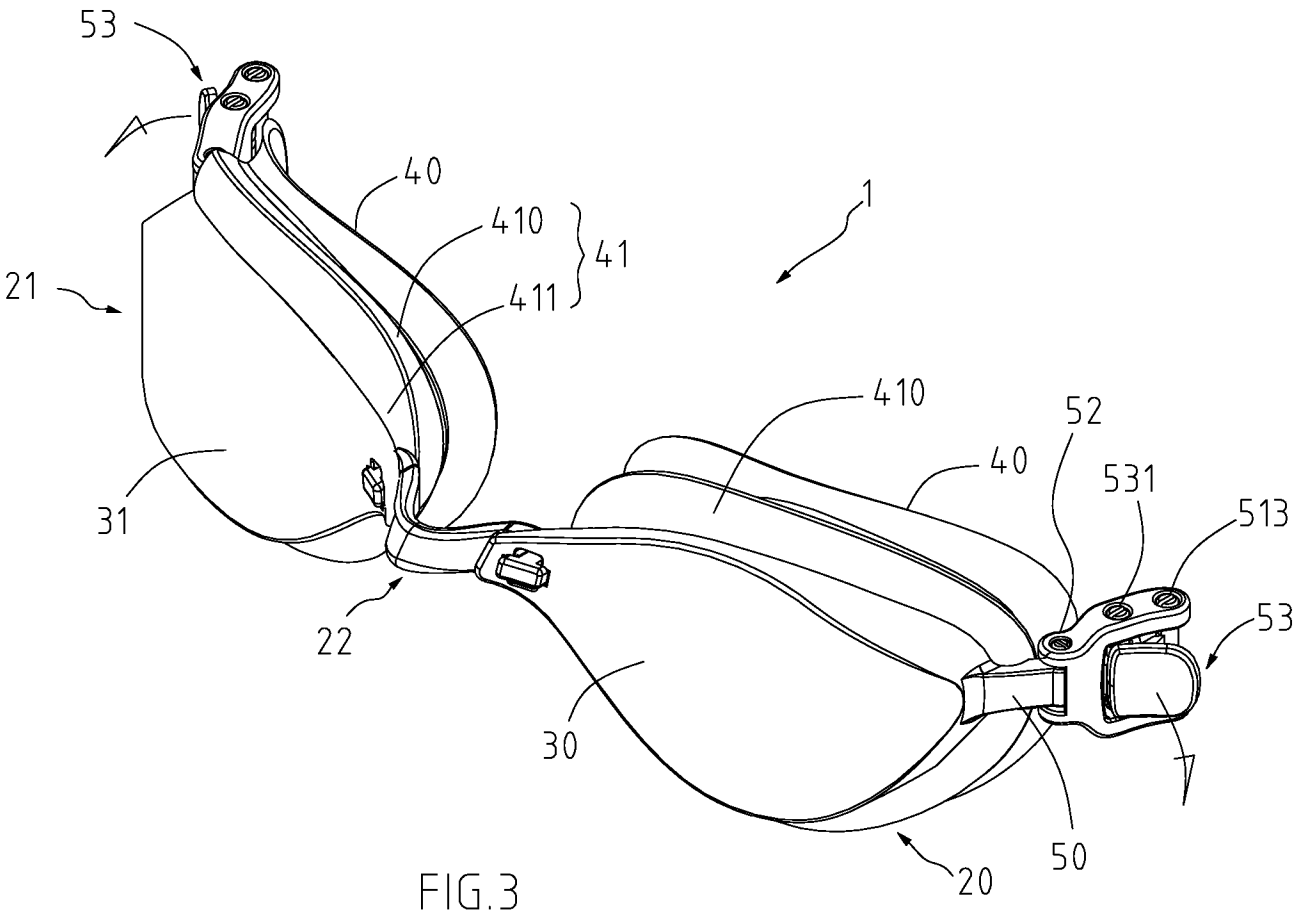
FIG. 3 is a perspective assembly view of FIG. 1.
Figure 4A:
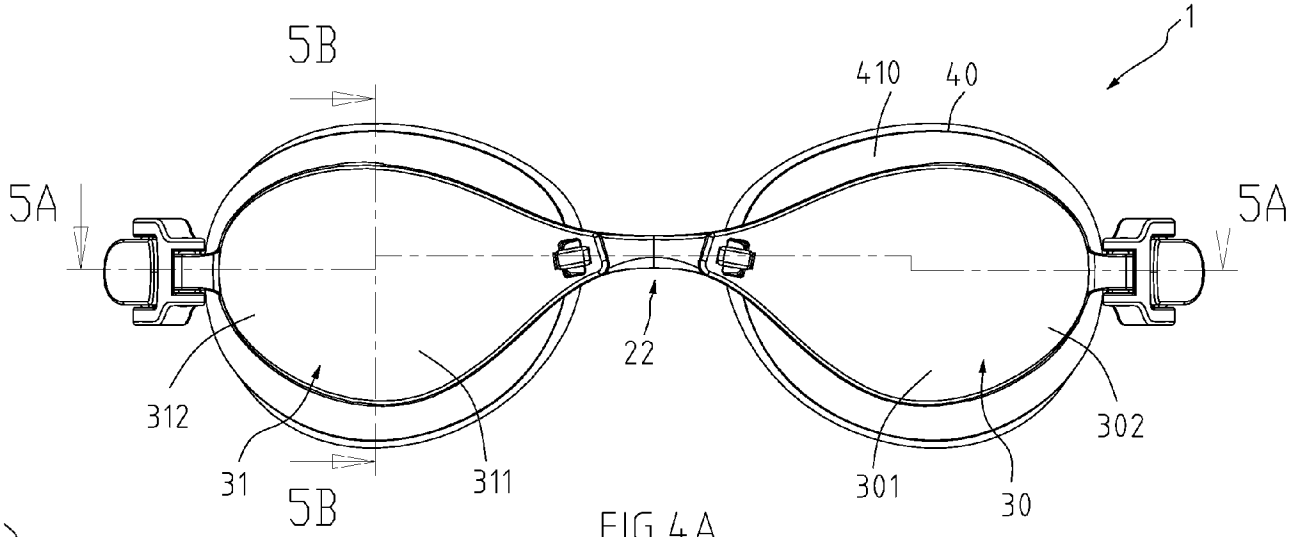
FIGS. 4A, 4B, 4C and 4D are respectively a front elevational view, a top plan view, a bottom plan view, and a right side elevational view of FIG. 3.
Figure 4B:
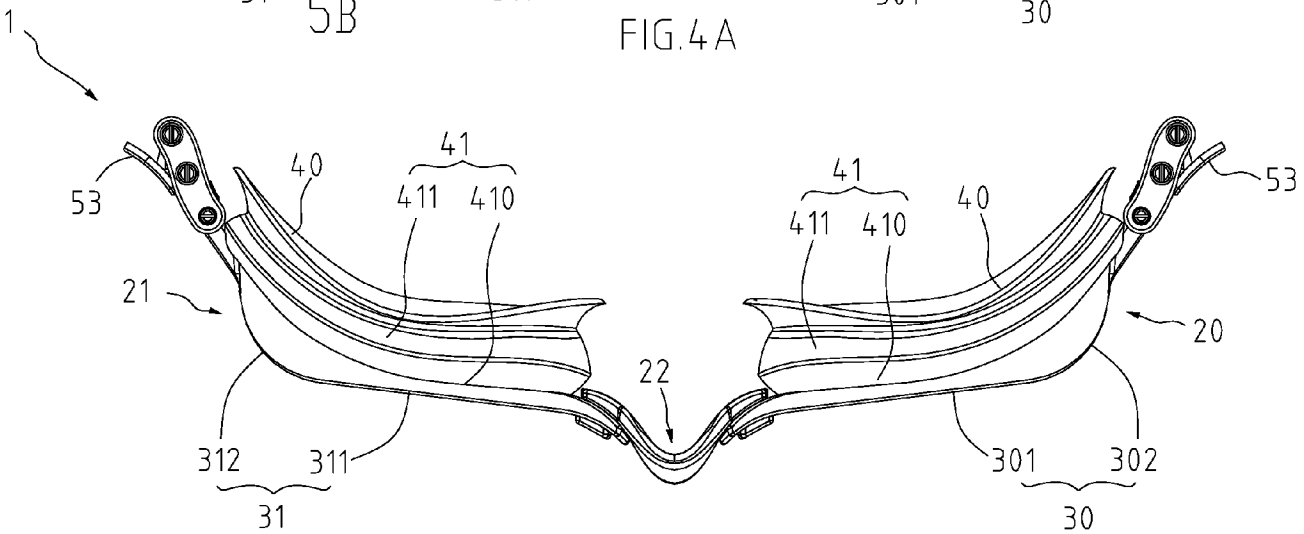
Figure 4C:
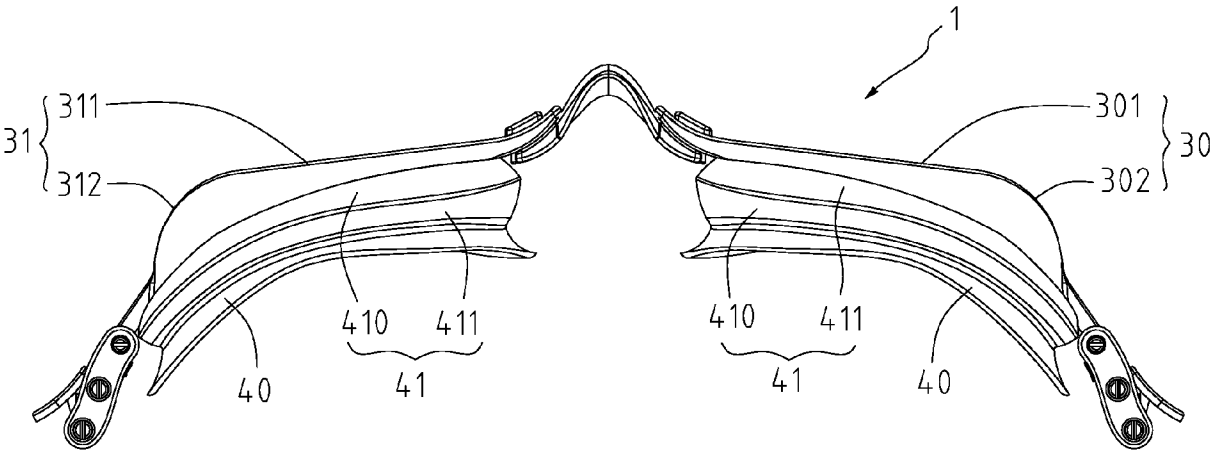
Figure 4D:
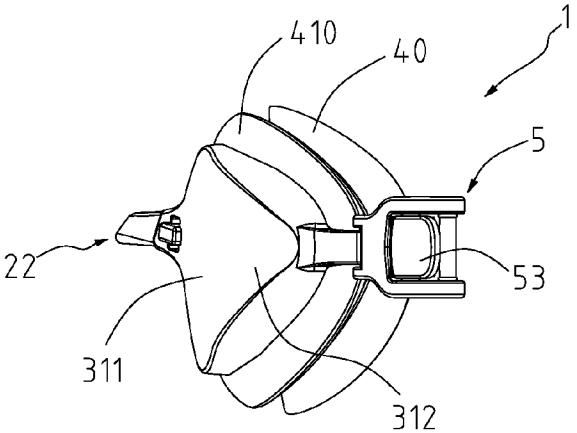

The restraining device 53 comprises a positioning peg 531 and a restraining tab 532. The positioning peg 531 is mounted to the third connecting hole 515 of the strap buckle 51. One side 533 of the restraining tab 532 extends outward to form a positioning sleeve 534 (as shown in FIGS. 1 and 2) being pivotally mounted to the positioning peg 531. At least a cantilever arm 535 is disposed adjacent to the positioning sleeve 534, one end 536 of the at least a cantilever arm 535 is fixedly mounted to the restraining tab 532 and another end 537 thereof is bent to be propped against the strap buckle 51. Moreover, an engaging tooth 538 is disposed on the one side of the restraining tab 532 and extends toward the strap through hole 511. With the above structures, in a normal state the engaging tooth 538 is engaged with one of the engaging slots 60 of the head strap 6 to allow the head strap 6 to be drawn in a single direction in order to be tightened. When the restraining tab 532 is being pulled outward at an angle (as an arrow direction shown in FIG. 5A), with the end 537 of the cantilever arm 535 propped against the strap buckle 51 (as dashed lines shown in FIG. 1), the strap buckle 51 is driven to rotate about the strap rod 52 in a direction same as the restraining tab 532 being pulled until hits against the limiting wall 5141 of the base 50, and therefore the engaging tooth 538 disengages the one of the engaging slots 60 so as to loosen the head strap 6. That is, the cantilever arm 535 is being deformed to generate stored energy when being propped against the strap buckle 51. The head strap 6 is allowed to move in a front or rear direction to a desired position without affecting the attachment of the face contact portion 40 to the face portion with respect to the outer peripheral portion of the eye socket. Consequently, the adjustment of the head strap will not make eyes uncomfortable or even cause red circle eyes as do the conventional swimming goggles.

As described above, the restraining device 53 is rotatably mounted to the strap buckle 51 and enables the strap buckle 51 to be rotatable individually. Therefore, the attachment of the face contact portion 40 to the face portion is not affected when the head strap 6 is being adjusted through the restraining device 53 without taking off the swimming goggles.

Figure 9:
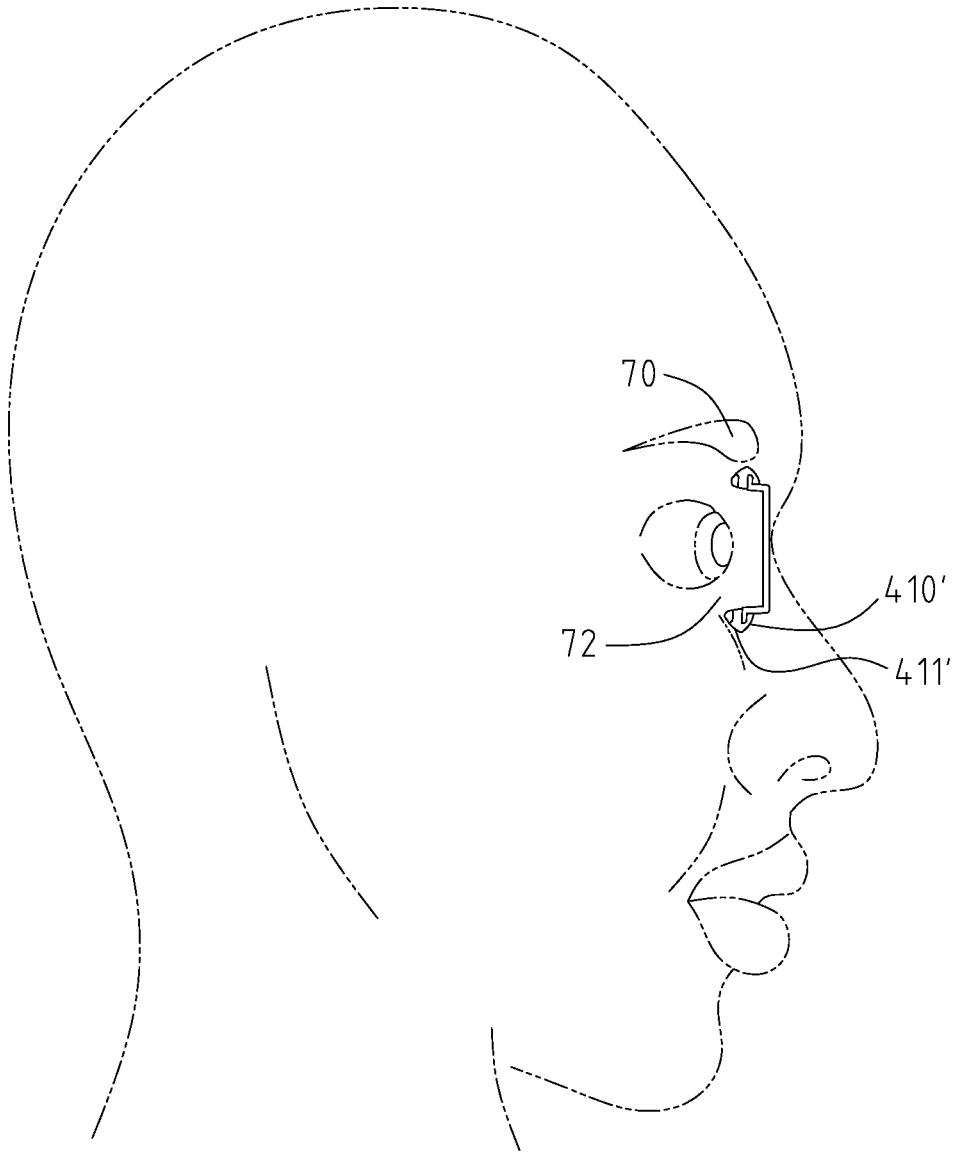
FIG. 9 is a schematic side view illustrating the swimming goggles being worn on a wearer in accordance with the second embodiment of the present invention.

Referring to FIGS. 7A to 9 illustrating a second embodiment of swimming goggles 1' of the present invention, in this embodiment the swimming goggles comprise a left frame body 20', a right frame body 21', a connecting element 22', lenses 30' and 31', protective pads 4' and face contact portions 40'. The major difference between the first and second embodiment is that the protective pads 4 of the second embodiment only comprise connecting portions 41' having connecting faces 410' coupled with abutting faces 411', the face contact portions 40 of the first embodiment not provided in the second embodiment. The abutting faces 411', one of aspects of the present invention, are inclined with respect to the face portion corresponding to the outer peripheral portion of the eye socket. Referring to FIG. 9 in combination with FIG. 10, in other words, each of the abutting faces 411' is inclined with respect to the face portion defined to correspond to the area above the eye socket and adjacent to the eyebrow 70, the side portion of the nose bridge adjacent to lacrimal gland 71 at the inner side portion of the eye socket, the area 62 adjacent to the under-eye bag 72 below the eye socket, and the outer eye corner 73 with respect to the outer side portion of the eye socket adjacent to a temple. Thus the swimming goggles 1' are perfectly smoothly attached to the face portion.

Accordingly, the abutting faces 411 and the face contact portions 40 of the swimming goggles 1 of the first embodiment, and the abutting faces 411' of the swimming goggles 1' of the second embodiment are respectively inclined with respect to the outer peripheral portions of the eye sockets, whereby enabling the swimming goggles 1 and 1' to be comfortably and smoothly attached to the contours of the outer peripheral portions of the eye sockets, wherein the face contact portions 40 of the first embodiment remain a less buffering portion with the abutting faces 411. As a result, unlike the protective pads of the convention swimming goggles that remain a large buffering area with the face portion and have to be worn with a greater tightening force, the face contact portions 40 of the present invention are attached to the face portions with a moderate force so as to provide a comfortable contact in wearing. Likewise, the swimming goggles of the second embodiment formed without the face contact portion are more easily to be attached to the face contact portions with respect to the contours of the outer peripheral portions of the eye sockets, whereby ensuring that the swimming goggles are worn comfortably without water leakage.

It is understood that the invention may be embodied in other forms within the scope of the claims. Thus the present examples and embodiments are to be considered in all respects as illustrative, and not restrictive, of the invention defined by the claims.

What is claimed is:

1. Swimming goggles, comprising:

a left frame body and a right frame body, each of the left and right frame bodies having an inner peripheral face and an outer peripheral face;

lenses respectively integrally formed with the outer peripheral faces of the left and right frame bodies;

a connecting element interconnecting the left and right frame bodies;

protective pads respectively attached to the inner peripheral faces of the left and right frame bodies, each of the protective pads having a connecting portion comprising a connecting face and an abutting face; and head strap apparatus respectively disposed on outer sides of the left and right frame bodies;

wherein lip portions are respectively formed along the inner peripheral faces of the left and right frame bodies, the connecting faces of the connecting portions integrally encompass the lip portions, the protective pads further comprise a face contact portion coupled with the abutting face of the connecting portion, and has curved contours with respect to a face portion corresponding to an outer peripheral portion of an eye socket of a cranium, and an upper half part of the face contact portion located with respect to the eyebrow and a lower half part of the face contact portion located with respect to the under-eye bag are curved at different angles as viewed from top and bottom plans, whereby the swimming goggles capable of being slightly adjusted to fit for the face portions with respect to the outer peripheral portions of the eye sockets where the face contact portions remain a less space with the abutting faces so as to enable the swimming goggles to be worn comfortably with a moderate attached force;

wherein the connecting element has opposite two ends respectively forming connecting pegs, each of the connecting pegs comprising a neck portion and an engaging portion, one side of each of the left and right frame bodies integrally extends outward to form a connecting base, and the connecting base is defined with a connecting hole where the neck portion is pivotally installed therein with the engaging portion mounted over the connecting base so as to connect the left and right frame bodies and to enable the left and right frame bodies to be rotatable with respect to the connecting pegs;

wherein each of the head strap apparatus comprises a base, a strap buckle and a shaft rod, the bases integrally respectively extend from sides of the left and right frame bodies and respectively form axial holes thereon, the strap buckle comprises a coupling opening, a first connecting hole, a second connecting hole, and a strap through hole, the coupling opening is intended to accommodate the base and is defined with a limiting wall, a guiding peg is mounted to the second connecting hole to define the strap through hole, and the shaft rod passes through the first connecting hole to be installed in the axial holes so as to pivotally connect the strap buckle with the base, whereby the strap buckle being rotatable with respect to the shaft rod against the limiting wall so as to fit for various sizes of heads of wearers.

2. The swimming goggles of claim 1, wherein the abutting face and the face contact portion are integrally formed together through double shot injection molding, the abutting face has a recessed surface comprising a long side portion and a short side extending and bending from the long side in cross section, the long and short sides together provide a large area for providing a better grab with the face contact portion and facilitating integrally injection molding, and the short side functions as a boundary side against a plastic material when performing injection molding so as to prevent burrs from being produced on the juncture of the abutting face and the face contact portion.

3. The swimming goggles of claim 1, wherein each of the lenses has a flat portion and a continuous curved portion, the flat portion is positioned in front of an eye from the nose bridge to the outer eye corner, and the continuous curved portion extends and smoothly curves from the flat portion with numerous arc faces smoothly curving from each other to reflect an area from the outer eye corner to a zygomatic bone in such a manner that each of the numerous arc faces of the continuous curved portion is curved at different angles with slope continuity, whereby the lenses are capable of being fit for the face portions with respect to the outer peripheral portions of the eye sockets, reducing water resistance in swimming, and providing a broad visual field after being worn.

4. The swimming goggles of claim 1, wherein each of the left and right frame bodies has an upper thickness relative to the eyebrow and a lower thickness relative to the under-eye bag in vertical cross section, and the upper thickness is less than the lower thickness so as to allow each of the left and right frame bodies to be fit for contours of the eyebrow and the under-eye bag, whereby preventing visual fields of eye corners from being blocked by the left and right frame bodies in swimming.

5. The swimming goggles of claim 1, wherein the engaging portions of the connecting pegs and the connecting holes of the connecting bases are formed in a non-round geometric shape.

6. The swimming goggles of claim 1, wherein each of the head strap apparatus further comprises a restraining device partially disposed in the strap through hole, and a head strap having multiple engaging slots, the restraining device comprising a positioning peg and a restraining tab, the positioning peg being mounted to the strap buckle adjacent to the strap through hole, one side of the restraining tab extending outward to form a positioning sleeve being pivotally mounted to the positioning peg, at least a cantilever arm disposed adjacent to the positioning sleeve, one end of the at least a cantilever arm fixedly mounted to the restraining tab and another end thereof being bent to be propped against the strap buckle, and an engaging tooth disposed on the one side of the restraining tab and extending toward the strap through hole, wherein in a normal state the engaging tooth is engaged with one of the engaging slots of the head strap to allow the head strap to be drawn in a single direction in order to tighten, and when the restraining tab is being pulled outward, with the cantilever propped against the strap buckle, the strap buckle is forced to rotate about the strap rod and the engaging tooth therefore disengages the one of the engaging slots so as to loosen the head strap.

* * * * *